US008794439B2

(12) United States Patent
Charles

(10) Patent No.: US 8,794,439 B2
(45) Date of Patent: Aug. 5, 2014

(54) PRODUCT PACKAGING

(76) Inventor: Lawrence Charles, Los Angeles, CA (US)

( * ) Notice: Subject to any disclaimer, the term of this patent is extended or adjusted under 35 U.S.C. 154(b) by 116 days.

(21) Appl. No.: 13/431,805

(22) Filed: Mar. 27, 2012

(65) Prior Publication Data

US 2012/0247995 A1 Oct. 4, 2012

Related U.S. Application Data

(60) Provisional application No. 61/469,262, filed on Mar. 30, 2011.

(51) Int. Cl.

| | |
|---|---|
| ***B65D 85/00*** | (2006.01) |
| ***B65D 5/498*** | (2006.01) |
| ***B65D 5/50*** | (2006.01) |
| ***B65D 5/62*** | (2006.01) |
| ***B65D 5/49*** | (2006.01) |

(52) U.S. Cl.

CPC ..... *B65D 5/48028* (2013.01); *B65D 5/48048* (2013.01); *B65D 5/5038* (2013.01); *B65D 5/62* (2013.01)

USPC ..... 206/499; 206/427

(58) Field of Classification Search

CPC ..... B65D 85/62; B65D 71/02

USPC ..... 206/153, 155, 161, 430, 434, 499, 427

See application file for complete search history.

(56) References Cited

U.S. PATENT DOCUMENTS

| | | | | |
|---|---|---|---|---|
| 2,893,550 | A * | 7/1959 | Sandmeyer | 206/499 |
| 4,136,772 | A * | 1/1979 | Mascia et al. | 206/199 |
| 4,744,464 | A * | 5/1988 | Noe | 206/422 |
| 5,044,498 | A * | 9/1991 | Galiegue et al. | 206/429 |
| 5,046,616 | A * | 9/1991 | Makowski et al. | 206/467 |
| 2005/0126946 | A1 * | 6/2005 | Holley, Jr. | 206/427 |

* cited by examiner

*Primary Examiner* — David Fidei

(74) *Attorney, Agent, or Firm* — DLA Piper LLP (US)

(57) ABSTRACT

Described herein are systems relating to packaging boxes. In some implementations, the packaging boxes include one or more trays used to support product cups, such as k-cups. The product cups, for example, can be used to hold tea, coffee, or flavoring. Some examples of flavoring include honey or other liquid flavoring a user can add to tea or coffee to adjust the flavor of the tea or coffee (e.g., honey comb and lemon grass, creamer, orange marmalade, mint peach, etc.). The packaging boxes can include a longitudinal axis parallel to the top and a long side of the box. The trays placed in the packaging boxes, for example, can have a similar longitudinal axis parallel to the longitudinal axes of the packaging box.

5 Claims, 5 Drawing Sheets

PRODUCT PACKAGING

CROSS-REFERENCE TO RELATED APPLICATIONS

This application claims the benefit of priority of U.S. provisional application No. 61/469,262, filed on Mar. 30, 2011, which is incorporated herein by reference.

BACKGROUND

Tea is the agricultural product of the leaves, leaf buds, or stems of various varieties of the Camellia sinensis plant, processed and cured using various methods. The word "tea" occasionally refers to the aromatic beverage prepared from the cured leaves by combination with water. Occasionally, loose-leaf tea is placed in an infuser or a tea bag is placed in a cup during the tea brewing process.

Coffee is a brewed drink prepared from roasted seeds, called coffee beans, of the coffee plant. Ground coffee can be placed in a filter of a coffee maker or in a French press during the process to make coffee. Sometimes, during the brewing process, a coffee bag is steeped in hot water.

Some coffee and tea makers automate the brew making process by quickly brewing a single serving of coffee or tea using a pod, pad, or cup that contains the desired flavor of coffee or tea. For example, pre-packaged ground coffee beans are placed in a coffee pod, which includes a filter, and the coffee pod is used to brew a cup of coffee. The pods, pads, or cups can be sealed to protect the coffee or tea from oxygen and moisture that would cause the coffee or tea to spoil.

Some automated brewers can heat water to a temperature around 192° Fahrenheit, direct the hot water through the pod, and prepare a single serving of coffee, tea, or another hot beverage in about 20 to about 60 seconds. Some examples of prepackaged coffee or tea include "k-cups," "t-discs" and packages made for systems such as Flavia and Nespresso.

SUMMARY

Described herein are systems relating to packaging boxes. In some implementations, the packaging boxes include one or more trays used to support product cups, such as k-cups. The product cups, for example, can be used to hold tea, coffee, or flavoring. Some examples of flavoring include honey or other liquid flavoring a user can add to tea or coffee to adjust the flavor of the tea or coffee (e.g., honey comb and lemon grass, creamer, orange marmalade, mint peach, etc.).

The packaging boxes can include a longitudinal axis parallel to the top and a long side of the box. The trays placed in the packaging boxes, for example, can have a similar longitudinal axis parallel to the longitudinal axes of the packaging box.

In some implementations, each packaging box includes two trays and each tray supports between about four and about eight product cups. In other implementations, each packaging box includes four trays and each tray supports between about three and about six product cups.

In another implementation, a packaging box includes multiple dividers that form separate apertures in the packaging box. Each of the apertures can be used to hold a product in place, such as a tea bag.

The packaging boxes can be made from opaque materials, such as recycled cardboard or cardstock. Alternatively, the packaging boxes can be manufactured from translucent material, such as frosted plastic.

The details of one or more implementations are set forth in the accompanying drawing and description below. Other features, objects, and advantages will be apparent from the description and drawings.

DESCRIPTION OF DRAWINGS

Like reference symbols in various drawing indicate like elements.

DETAILED DESCRIPTION OF ILLUSTRATIVE IMPLEMENTATIONS

Figure 1A:
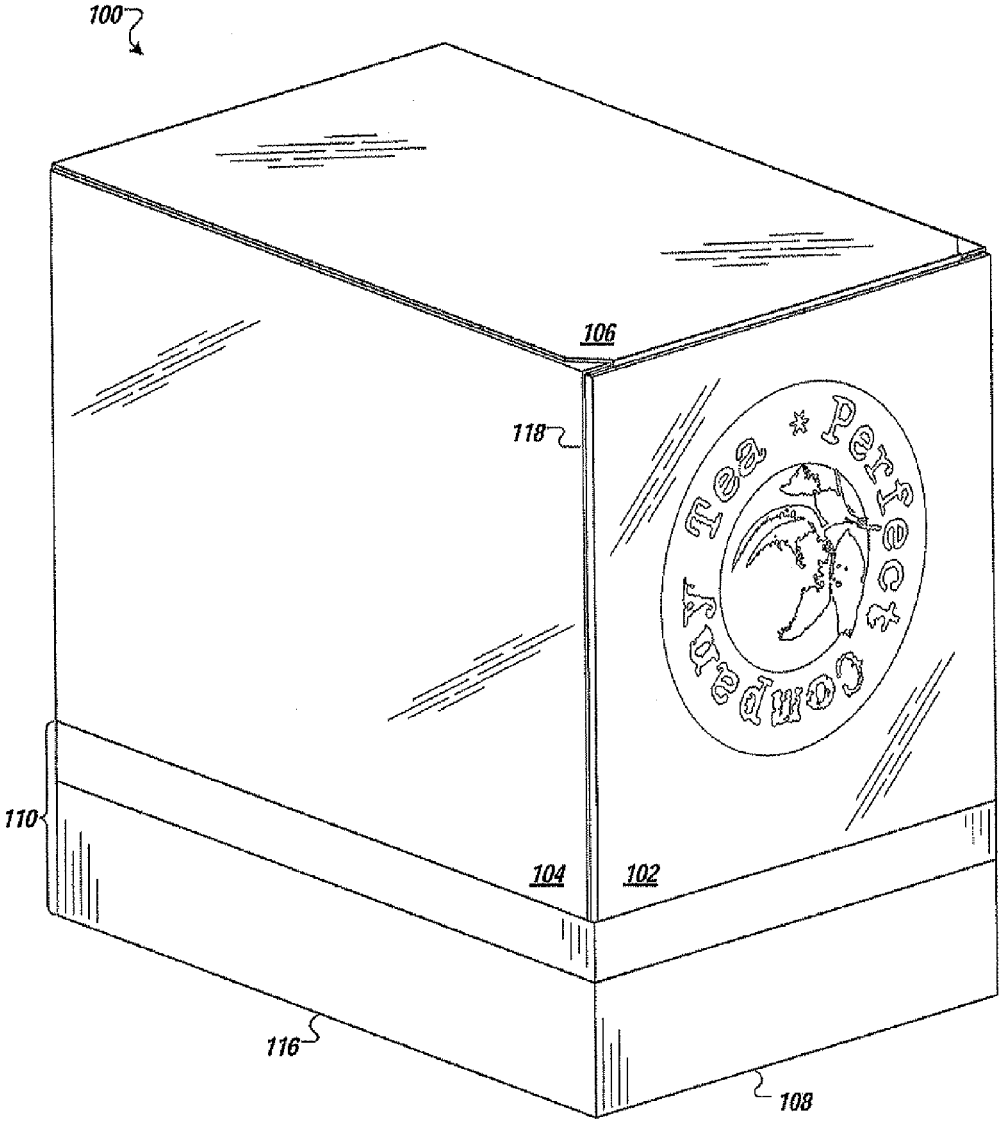
FIGS. 1A-B illustrate perspective views of a large product box.
Figure 1B:
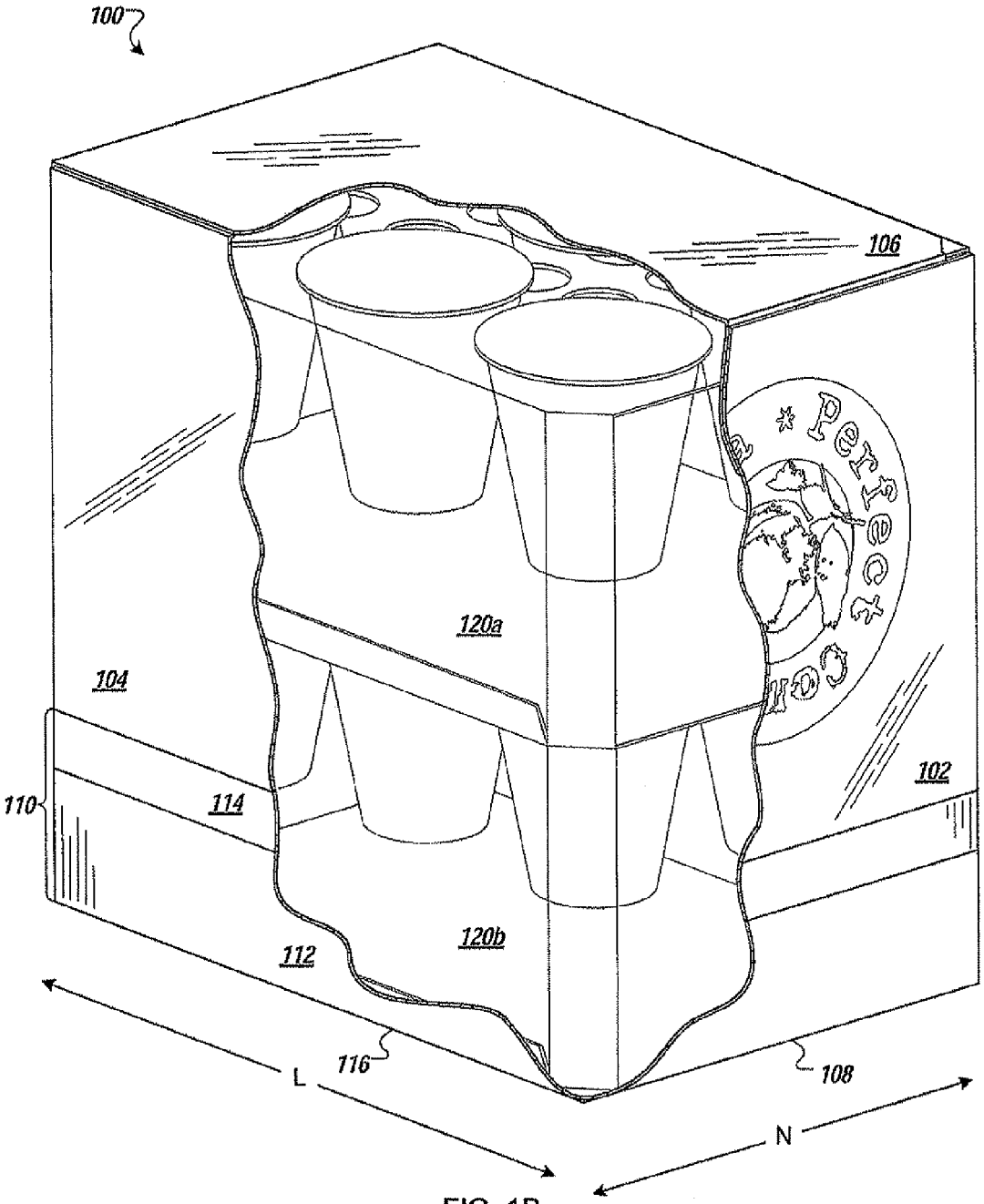

FIGS. 1A-B illustrate perspective views of a large product box 100. The large product box 100 includes a front surface 102, a first side surface 104, and a top surface 106. Additionally, the large product box 100 includes a back surface, a second side surface, and a bottom surface (not shown).

The front surface 102 is fixedly mounted to the bottom surface. For example, the front surface 102 is made from the same piece of material as the bottom surface and the material is folded along a first edge 108 separating the front surface 102 from the bottom surface.

Alternatively, the front surface 102 is fixedly mounted to the bottom surface with adhesive that holds the front surface 102 in place with respect to the bottom surface. In other implementations, fasteners attach the front surface 102 to the bottom surface along the first edge 108.

In some implementations, the front surface 102 includes a logo. The logo, for example, depicts a company or a product name associated with a product (e.g., coffee or tea) located in the large product box 100. Alternatively, the first side surface 104 includes a company logo and the front surface 102 includes a product logo. The location and types of logos placed on the large product box 100 may vary.

The front surface 102 is made from a translucent polymer, such as plastic. For example, a recycled plastic with an opacity between about 25% to about 90%, preferably between about 30% to about 75%, more preferably about 50%, is used for the front surface 102. In another example, the front surface 102 is manufactured from a frosted plastic.

The front surface 102 is optionally manufactured from paper stock. For example, paper stock with a weight between about 0 to about 500 pounds is used, preferably between 50 to about 110 pounds, more preferably about 100 pounds. The paper stock can be recycled and/or have a raw or natural appearance.

In some implementations, the front surface 102 includes a border 110 that is adjacent to an edge of the front surface 102. For example, the border 110 can be adjacent to the first edge 108. Alternatively, the border 110 is positioned along another edge or all edges of the front surface 102.

The border 110 is silk screened onto the front surface 102. For example, the border 110 is ink that has been printed on a portion of the front surface 102 and the front surface 102 is made from a unitary piece of material. Alternatively, the border 110 is attached to the front surface 102. For example, the border 110 is paperboard attached to a front surface 102 manufactured from plastic. The paperboard is attached to the plastic using adhesive, such as glue, in this example, the border 110 extends out from the front surface 102.

The border 110 is manufactured from a different material and/or has a different appearance than the front surface 102. For example, the border 110 is black plastic and the front surface 102 is frosted white plastic. Alternatively, the border 110 can be made from cardboard or another natural fiber and the front surface 102 can be made from synthetic fiber.

In certain implementations, the border 110 includes a lower border 112 and an upper border 114. For example, the lower border 112 is made from cellulose (e.g., paperboard) and the upper border 114 is made from polymer.

The lower border 112 and the upper border 114 can include different designs or patterns. For example, the lower border 112 is a solid black color and the upper border 114 includes vertical stripes of color.

The first side surface 104, the second side surface, and the back surface are fixedly mounted to the bottom surface. For example, the first side surface 104 is fixedly mounted to the bottom surface along a second edge 116. The first side surface 104, the second side surface and the back surface are mounted to the bottom surface in a similar manner to the mounting of the front surface 102 to the bottom surface. For example, the front surface 102, the first side surface 104, the back surface, the second side surface, and the bottom surface are all made from a single sheet of material.

In some implementations, the front surface 102, the first side surface 104, the back surface, and the second side surface are attached to the bottom surface in different ways. For example, the front surface 102, the bottom surface, and the back surface are made from a single sheet of material and the first side surface 104 and the second side surface are attached to the bottom surface with adhesive.

In certain implementations, one or more of the surfaces are attached together with a lip. For example, the first side surface 104 includes a lip along a third edge 118 and adhesive applied to the lip attaches the first side surface 104 to the front surface 102.

The top surface 106 is hingedly attached to the back surface. For example, the top surface 106 is attached to the back surface to allow a user to open and close the large product box 100. In some implementations, the top surface 106 and the back surface are made from the same sheet of material.

Alternatively, the top surface 106 is manufactured from a different sheet of material from the back surface. For example, the top surface 106 is attached to the back surface with hinges.

The materials used to manufacture the large product box 100 can be interchanged between the various parts (e.g., surfaces) of the large product box 100. For example, all parts of the large product box 100 can be manufactured from the same material. Alternatively, any part of the large product box 100 can be made from any of the materials described above or below with reference to product boxes.

FIG. 1B illustrates a cut out perspective view of the large product box 100. The large product box 100 includes one or more product trays 120*a-b* used to support products in the large product box 100. For example, each of the product trays 120*a-b*, described in more detail below, support a plurality of products, such as product cups that contain coffee or tea. In another example, the product cups contain flavoring that a user can add to coffee or tea.

The large product box 100 includes an aperture located between the front surface 102, the first side surface 104, the top surface 106, the back surface, the second side surface, and the bottom surface. The aperture removably supports one or more of the product trays 120*a-b*. For example, an upper facing of the bottom surface supports a bottom facing of one of the product trays 120*a-b*. When a user opens the top surface 106, the user has access to at least one of the product trays 120*a-b* and is able to remove the at least one product tray 120*a* from the large product box 100.

Each of the product trays 120*a-b* includes a longitudinal axis L parallel to the second edge 116 and the long side of the large product box 100. For example, the longitudinal axis L is parallel to a longitudinal axis of the large product box 100.

The height of the large product box 100 is between about 2 to about 5 inches, preferably between about 2¼ to about 4 inches, more preferably between about 2½ to about 3¾, inches. For example, the height of the large product box 100 is selected based on the size of the product trays 120*a-b* or other products placed in the aperture of the large product box 100.

The width of the large product box 100 is between about 2 to about 4 inches, preferably between about 2¼ to about 3½ inches, more preferably between about 2½ to about 3 inches. For example, if each of the product trays 120*a-b* are about 1½ inches wide and three product trays 120*a-b* support three rows of products cups along a latitudinal axis N normal to the longitudinal axis L, the large product box 100 has a width of about 4½ inches, and if the product trays 120*a-b* support two rows of product cups along the latitudinal axis N, the large product packaging has a width of about 3 inches.

The depth of the large product box 100 is between about 3 to about 8 inches, preferably between about 3½ to about 6 inches, more preferably between about 4 and about 5 inches. For example, the depth of the large product box 100 is 4½ inches and each of the product trays 120*a-b* supports three product cups along the longitudinal axis L.

Figure 2A:
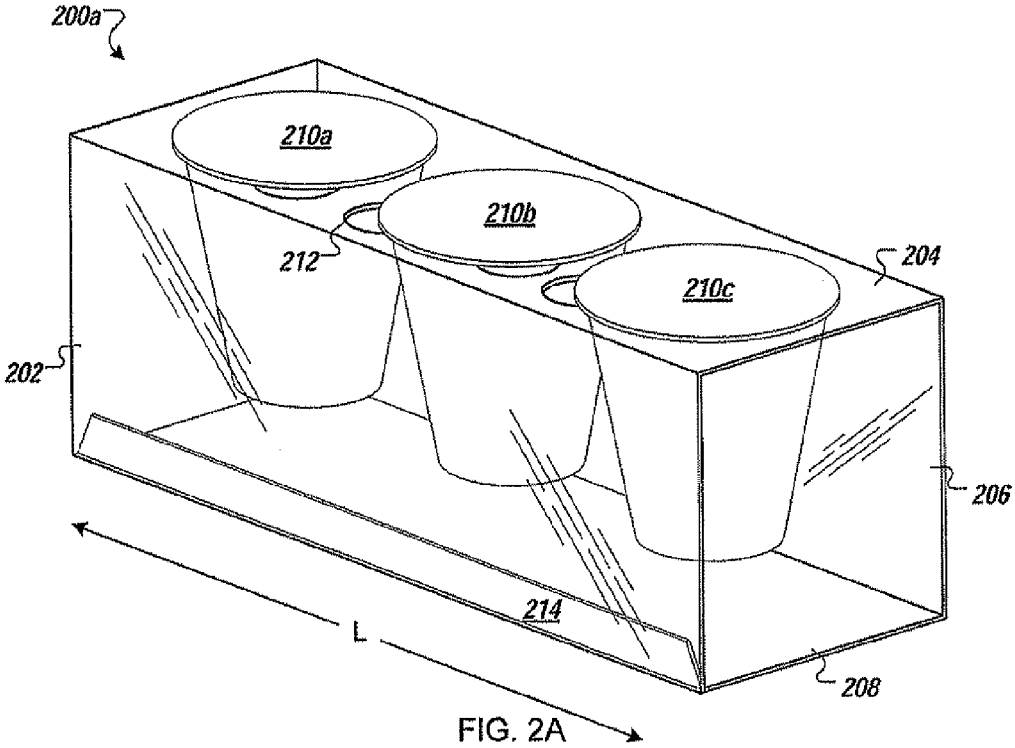
FIGS. 2A-B illustrate perspective views of product trays.
Figure 2B:
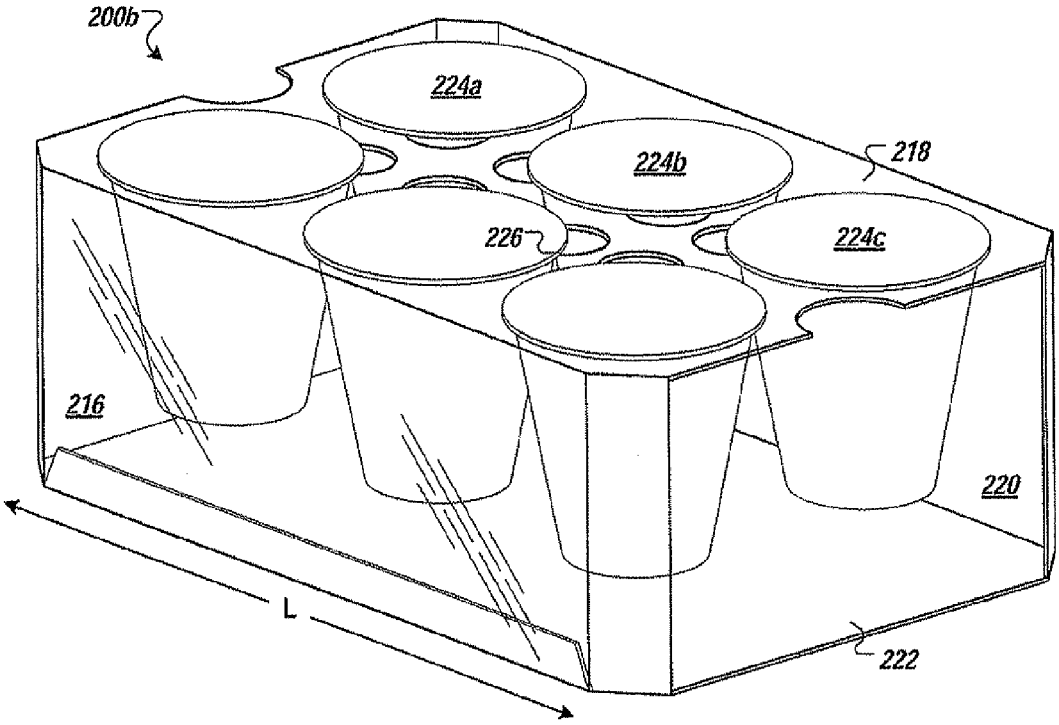

FIGS. 2A-B illustrate perspective views of product trays 200. A small product tray 200*a* includes a first side surface 202, a top surface 204, a second side surface 206, and a bottom surface 208. The dimensions of the surfaces are selected to allow about 2-4 small product trays 200*a* to rest side by side in a row in the aperture of the large product box 100.

For example, two small product trays 200*a* rest on the upper facing of the large product box's 100 bottom surface. In this example, the small product tray has a width between about 1 to about 2 inches, preferably between about 1⅛ to about 1¾ inches, more preferably between about 1¼ to about 1½ inches.

The large product box 100 supports two small product trays 200*a* resting one on top of the other. For example, a first small product tray rests on the upper facing of the large product box's 100 bottom surface and a second small product tray rests on the top surface of the first small product tray. In this example, the height of the small product tray 200*a* is between about 1 to about 2½ inches, preferably between about 1⅛ to about 2 inches, more preferably between about 1¼ to about 1⅞ inches.

The depth of the small product tray 200*a* is about the same as the depth of the large product box 100. For example, when the depth of the large product box 100 is about 4 inches, the depth of the small product tray 200*a* is less than about 4 inches to allow the small product tray 200*a* to be removed from the large product box 100.

In some implementations, the depth of the small product tray 200*a* is half the depth of the large product box 100. For example, if the large product box 100 has a depth of about 5 inches, the depth of the small product tray 200*a* is about 2½ inches.

The small product tray 200*a* supports a plurality of product cups 210*a-c*. For example, the small product tray 200*a* supports between about 2 to about 8 product cups 210*a-c*, preferably between about 2 to about 6 product cups 210*a-c*, more preferably between about 3 to about 5 product cups 210*a-c*. In some implementations, each of the product cups 210*a-c* includes tea, coffee, or a beverage flavoring. Each of the product cups 210*a-c* can include a different product, such as when the large product box 100 is sold as an assortment package. Alternatively, each of the product cups 210*a-c* contains a quantity of the same product.

A top surface of the product cups 210*a-c* rests on the top surface 204 of the small product tray 200*a*. In some implementations, when the top surface of the product cups 210*a-c* rests on the top surface 204 of the small product tray 200*a*, the small product tray 200*a* provides additional support to the product cups 210*a-c*. In other implementations, each of the support apertures in the top surface 204 of the small product tray 200*a* support the product cups 210*a-c* below the top surface of the product cups 210*a-c*.

The small product tray 200*a* includes one or more finger apertures 212 adjacent to the apertures supporting the product cups 210*a-c*. The finger apertures 212 allow a user to remove the product cups 210*a-c* from the small product tray 200*a*. In some implementations, the finger apertures 212 allow the product cups 210*a-c* to be more easily removed from the small product tray 200*a* than if the small product tray 200*a* did not include the finger apertures 212.

In some implementations, the small product tray 200*a* includes a front surface and/or a back surface (not shown). In these implementations, the front surface and/or the back surface provide the small product tray 200*a* with additional support for holding the product cups 210*a-c*.

The small product tray 200*a* can be manufactured from the same materials as the large product box 100. In some implementations, the material used for the small product tray 200*a* compliments the material of the large product box 100 that is holding the small product tray 200*a*. For example, the small product tray 200*a* is manufactured from translucent plastic and the large product box 100 is manufactured from frosted plastic. In another example, when the large product box 100 supports multiple small product trays 200*a*, each of the small product trays 200*a* can be manufactured from a different material or a have a different appearance (e.g., color or texture).

The small product tray 200*a* is made from a single sheet of material. For example, an outline of the small product tray 200*a* is cut from a single sheet of cardboard and folded to form the first side surface 202, the top surface 204, the second side surface 206, and the bottom surface 208. A lip 214, attached to the bottom surface 208, is folder over and attached to the first side surface 202 with adhesive. Alternatively, the lip 214 is attached to the first side surface 202 with fasteners, such as staples.

FIG. 2B illustrates a large product tray 200*b*. The large product tray 200*b* includes a first side surface 216, a top surface 218, a second side surface 220, and a bottom surface 222. The large product tray 200*b* can be manufactured from the same materials as the small product tray 200*a*. In some implementations, the large product box 100 includes two large product trays 200*b*.

The side surfaces of the large product tray 200*b* can be connected in the same manner as the side surfaces of the small product tray 200*a*. For example, the large product tray 200*b* can be manufactured from a single sheet of material with the opposite ends attached with adhesive.

The height of the large product tray 200*b* is selected based on the height of the large product box 100 and the height of one or more product cups 224*a-c* supported by the large product tray 200*b*. For example, the height of the large product tray 200*b* can be between about ½ to about ¼ the height of the large product box 100. In one example, when the height of the large product box 100 is about 4 inches, the height of the large product tray 200*b* is about 2 inches.

In another example, the large product box 100 can include two large product trays 200*b* on top of a support box. For example, when the support box has the same height as the border 110, the large product box 100 can have a height of 3¾ inches and the border 110 can have a height of ¾ inches. In this example, each of the large product trays 200*b* has a height of 1½ inches. The height of the border 110 is between about 0 to about 2 inches, preferably between about 4 to about 1½ inches, more preferably between about ½ to about 1 inch.

The width of the large product tray 200*b* is about the same as the width of the large product box 100. For example, when the width of the large product box 100 is 4 inches, the width of the large product tray 200*b* is slightly less than 4 inches to allow the large product tray 200*b* to be removed from the large product box 100.

The depth of the large product tray 200*b* is about the same as the depth of the large product box 100. For example, when the depth of the large product box 100 is about 8 inches, the depth of the large product tray 200*b* is less than the depth of the large product box 100 (e.g., 7 15/16 inches) to allow the large product tray 200*b* to be removed from the large product box 100.

In some implementations, the depth of the large product tray 200*b* is half the depth of the large product box 100. For example, if the large product box 100 has a depth of 4½ inches, the depth of the large product tray 200*b* is 2¼ inches.

The large product tray 200*b* supports between about 4 to about 12 product cups 224*a-c*, preferably between about 4 to about 10 product cups 224*a-c*, more preferably between about 6 to about 8 product cups 224*a-c*. The product cups 224*a-c* are supported by the top surface 218 of the large product tray 200*b* in a similar manner that the product cups 210*a-c* supported by the top surface 204 of the small product tray 200*a*.

For example, the top surface 218 includes one support aperture corresponding to each of the product cups 224*a-c* where each support aperture supports a side edge of a corresponding product cup 224*a-c*. Each of the support apertures provides enough support to the corresponding product cups 224*a-c* to allow the product cups 224*a-c* to be easily removed from the aperture.

In some implementations, the top surface 218 of the large product tray 200*b* includes one or more finger apertures 226. Each of the finger apertures 226 corresponds to one of the apertures in the top surface 218 that support the product cups 224*a-c*. In certain implementations, two or more finger apertures 226 correspond to a single support aperture used to support one of the product cups 224*a-c*.

In various implementations, the large product tray 200*b* includes a back surface and a front surface (not shown). The back surface and the front surface provide additional support to the large product tray 200*b* for holding the product cups 224*a-c*. In certain implementations, the front surface and the back surface have finger apertures that correspond with the apertures in the top surface 218. For example, the front surface includes a finger aperture that coincides with the finger aperture on the front edge of the top surface 218, and the back surface includes a finger aperture that coincides with the finger aperture on the back edge of the top surface 218.

Figure 3A:
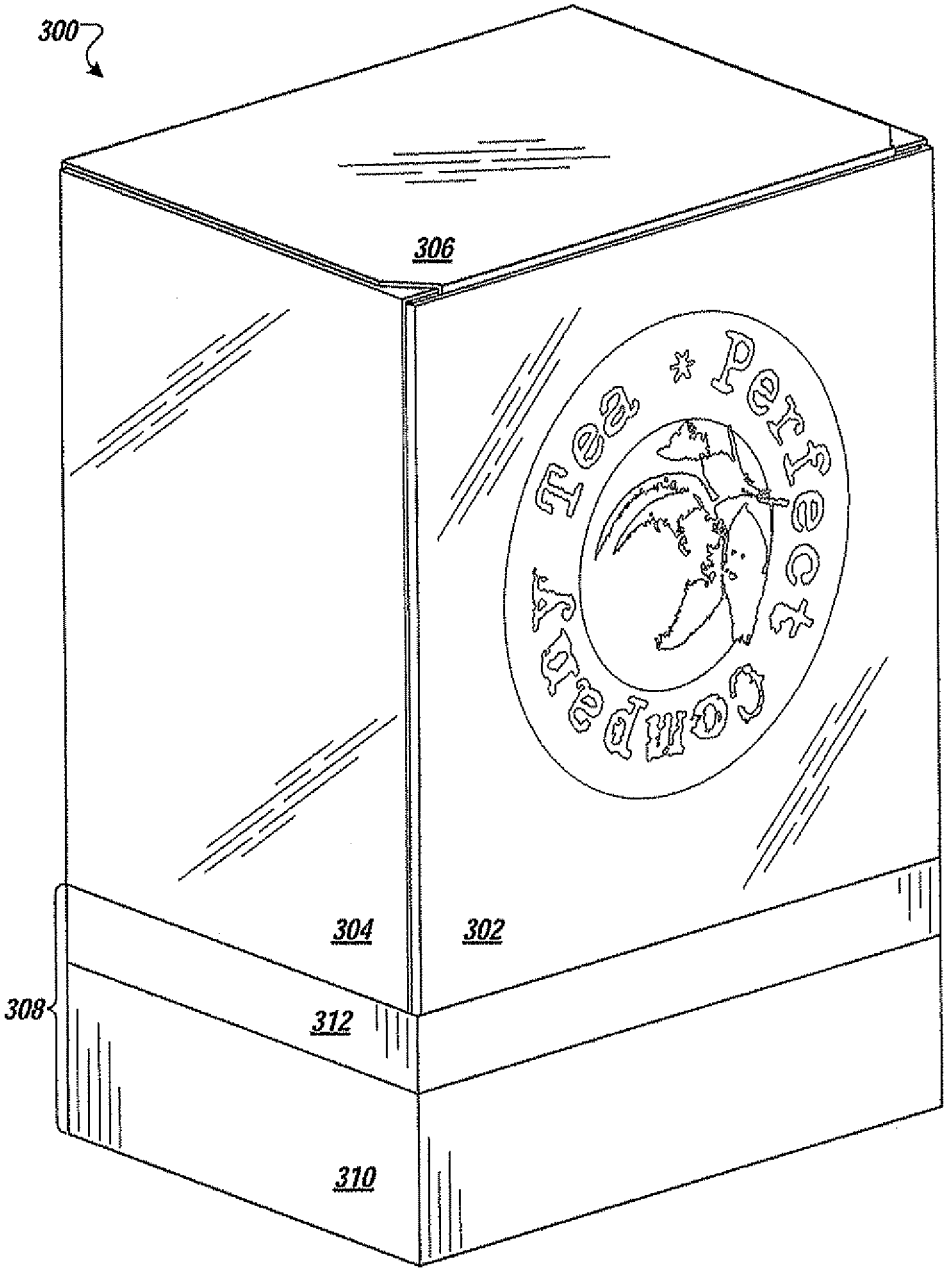
FIGS. 3A-B illustrate perspective views of a small product box.
Figure 3B:
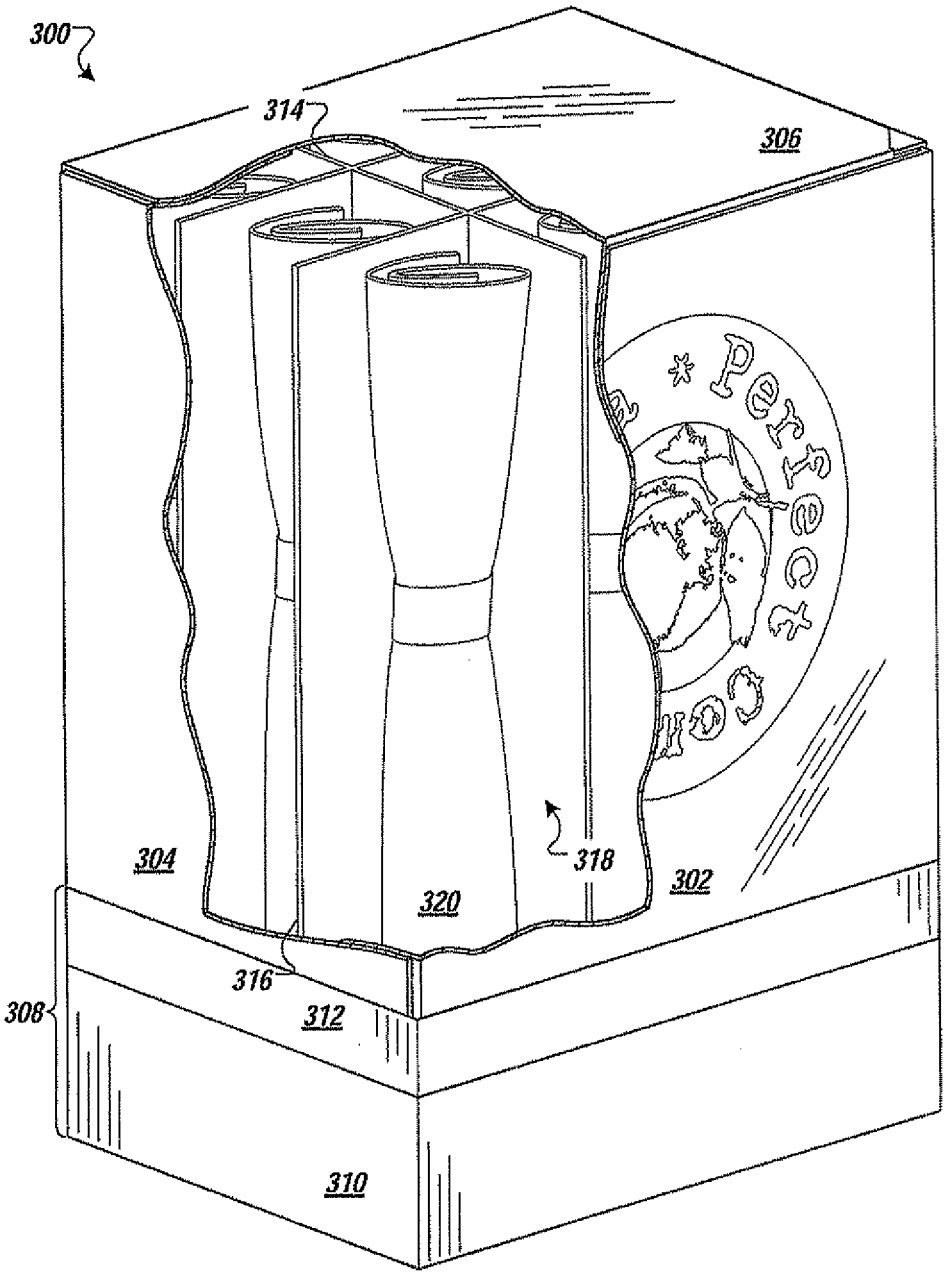

FIGS. 3A-B illustrate perspective views of a small product box 300. The small product box 300 supports one or more products, such as tea bags. In one example, the tea bags are supported horizontally. In some implementations, the tea bags are supported vertically by the small product box 300.

The tea bags can be either flat or rolled depending on the configuration of the small product box 300.

The small product box 300 includes a front surface 302, a first side surface 304, and a top surface 306. In some implementations, the front surface 302 includes a logo, such as a company or product logo, associated with the tea bags positioned in the small product box 300.

The small product box 300 includes a back surface, a second side surface, and a bottom surface (not shown). All of the surfaces of the small product box 300 are connected in a similar manner as the surfaces of the large product box 100. For example, the front surface 302, the first side surface 304, the back surface, and the second side surface are fixedly mounted to the bottom surface and the top surface 306 is hingedly mounted to the back surface allowing a user access to one or more products located in the small product box 300.

In some implementations, the small product box 300 is made from similar materials as the materials used to manufacture the large product box 100. For example, the small product box 300 includes a border 308 manufactured from paperboard and the sides and top of the small product box 300 are manufactured from unblended recycled papers.

The surfaces of the small product box 300 and the large product box 100 are flat. In some implementations, the small product box 300 and/or the large product box 100 have multiple different types of surfaces. For example, when cardboard is used, the small product box 300 can have an inner fluted medium.

In certain implementations, one or more of the surfaces of the small product box 300 and/or the large product box 100 include a textured surface or a partially textured surface. For example, one side of the top surface 306 is textured and the other side of the top surface 306 is smooth. Alternatively, one portion of the top surface 306 is textured (e.g., for better grip by a user opening the small product box 300) and the remaining portion of the top surface 306 is smooth.

In some implementations, the border 308 includes a lower border 310 and an upper border 312. The lower border 310 is made from materials similar to the lower border 112, and the upper border 312 is made from similar materials as the upper border 114. In certain implementations, the lower border 310 and/or the upper border 312 are manufactured from the same material as the front surface 302, the first side surface 304, and/or the top surface 306.

The materials used to manufacture the surfaces of the small product box 300 and/or the large product box 100 can be unbleached. Sometimes leaving the manufacturing material unbleached provides for a natural look to a product box. Alternatively, the large product box 100 and/or the small product box 300 can be made from a bleached material. For example, the material can be bleached in order to print a logo, image, or other coloring onto one of the surfaces of the product boxes.

Some of the materials used to manufacture the small product box 300 and/or the large product box 100 can be certified. For example, the material can be organic, fair-trade, non-genetically modified organism (GMO), or kosher certified.

The small product box 300 includes a plurality of longitudinal dividers 314 and a plurality of latitudinal dividers 316. The longitudinal dividers 314 and the latitudinal dividers 316 divide the small product box 300 into a plurality of apertures 318 where each aperture 318 supports one or more products 320. For example, a single aperture 318 supports a single tea bag that is rolled and placed vertically into the aperture 318.

The height of the small product box 300 is between about 2 to about 5 inches, preferably between about 2¼ to about 4 inches, more preferably between about 2½ to about 3¾ inches. For example, the height of the small product box 300 is selected based on the size of the products 320 placed in the apertures 318 of the small product box 300.

The width of the small product box 300 is between about 2 to about 4 inches, preferably between about 2¼ to about 3½ inches, more preferably between about 2½ to about 3 inches. For example, when the small product box 300 includes four products 320 across the width and each of the products 320 have a width of ½ inch, the small product box 300 has a width of 3 inches.

The depth of the small product box 300 is between about 1K to about 3 inches, preferably between about 2 to about 3 inches, more preferably between about 2% ¼ and about 2½ inches. For example, the depth of the small product box 300 is 3 inches to allow the small product box 300 to support a 4×4 grid of the products 320.

The longitudinal dividers 314 divide the small product box 300 into a grid with between about 1 to about 4 apertures on each longitudinal side and between about 1 to about 4 apertures on each latitudinal size. Preferably, each side of the small product box 300 is divided into between about 2 to about 3 apertures.

Tea bags are placed in the aperture 318 in a vertical position, where each tea bag is rolled up and fastened in place, e.g., with string. In some implementations, the tea bags are placed in a wrapper to ensure freshness of the tea.

In certain implementations, the wrapper is made from paper, such as recycled paper. In other implementations, the wrapper is manufactured from plastic or cellophane, in another implementation, the wrapper is made from wax paper with a foil lining, or some combination of paper, plastic, foil, metal, or cellophane.

When the small product box 300 includes dividers in only a single direction, e.g., between 1 and 3 latitudinal dividers 316 or between 1 and 3 longitudinal dividers 314, the tea bags can be placed in the apertures 318 in a horizontal position. For example, tea bags can be rolled and placed horizontally across the apertures 318. Alternatively, flat tea bags, with or without a wrapper, can be placed in the apertures 318.

In other implementations, the small product box 300 does not include any dividers. For example, rolled or flat tea bags are positioned in a longitudinal direction in the small product box 300. Alternatively, the tea bags can be positioned in a latitudinal direction across the bottom surface of the small product box 300.

In certain implementations, the small product box 300 includes a support box positioned on the bottom surface of the small product box 300. The support box, for example, raises the products 320 to allow the products to be viewed by a user. In some implementations, placing a support box in the small product box 300 allows the small product box 300 to have the same height as the large product box 100 while allowing the products 320 to be easily removed from the small product box 300.

In some implementations, the large product box 100 includes tea bags instead of the product trays 120*a-b*. For example, a plurality of flat tea bags can be positioned in the large product box 100. In another example, the flat tea bags can be positioned among latitudinal dividers. For example, between 1 and 8 dividers, preferably between 2 and 4 dividers can be evenly spaced along the longitudinal axis L of the large product box 100 to support the flat vertical tea bags.

Alternatively, when the large product box 100 includes only latitudinal dividers, roiled tea bags can be placed horizontally between the dividers. For example, between about 4 and about 8 rolled tea bags can be placed between each divider, preferably between about 4 and 6.

In implementations where rolled vertical tea bags are positioned in the large product box 100, the large product box 100 can be divided into multiple apertures that correspond with one or more of the rolled vertical tea bags. For example, the large product box 100 can include between about 1 and about 4 longitudinal dividers and between about 1 and about 4 latitudinal dividers.

The wrapper placed around the tea bags can include one or more flanges. For example, when the wrapper is made from plastic, a rolled tea bag can be placed in an opening of the wrapper that is along one of the longitudinal edges and the longitudinal edge can be sealed to form a flange. Alternatively, when more than a single side of the wrapper is unsealed, multiple flanges can be formed on the wrapper forming a seal to increase the shelf life of the tea or coffee included in the bag. For example, flanges can be formed on the top, bottom, or a combination of edges.

In some implementations, when the tea bags are rolled, the tea bags can be placed in a tube that helps increase the shelf life of the tea. For example, a tube formed from foil and plastic can be used to seal the tea bag.

The tea or coffee bags can include a tag attached to a string. The tag can be used to identify the flavor of tea in the bag. In certain implementations, the string can be used to remove the tea or coffee bag from a cup after the tea or coffee has steeped.

The tea or coffee bags placed in the small product box 300 or the large product box 100 can be manufactured from a natural fabric, such as silk. In some implementations, a synthetic polymer, such as nylon, is used during the manufacturing process. In certain implementations, the bags include between about 0 to about 50% polypropylene, preferably between about 0 and about 30% polypropylene or alternatively between about 30 and about 50% polypropylene.

In some implementations, the bags are manufactured from biodegradable material or a mesh. In one example, the bags are made from bamboo, and in another example, the bags are made from hemp.

In some implementations, materials used for the bags and/or the wrapper are certified. For example, the bags can have organic, fair-trade, non-GMO or kosher certification.

One implementation includes a system comprising a rectangular container. The rectangular container includes four side surfaces, a first top surface, a first bottom surface, and a first aperture. Each of the four side surfaces is fixedly mounted to an edge of the bottom surface and the top surface is hingedly mounted to one of the four side surfaces. A first longitudinal axis of the aperture is parallel to a second longitudinal axis of one of the four sides not hingedly mounted to the top surface.

In this implementation, the system includes at least one tray. The tray is supported by the first bottom surface and is positioned in the first aperture. Each tray includes at least one second aperture in a second top surface of the tray. Each second aperture supports a cup. A third longitudinal axis of the tray is parallel to the first longitudinal axis of the first aperture.

A number of embodiments have been described. Nevertheless, it will be understood that various modifications are optionally made without departing from the spirit and scope of this disclosure.

The invention claimed is:

1. A packaging box containing a product tray and a product cup, the product tray including a support aperture formed through the product tray, wherein the product cup is held in the support aperture with a part of the product cup being disposed above the product tray and a part of the product cup being disposed below the product tray, and a top surface of the product cup rests on a top surface of the product tray adjacent the support aperture such that the product tray supports the product cup.

2. The packaging box of claim 1, wherein the packaging box is rectangular and comprises:

a bottom surface that supports the product tray;

four side surfaces that are fixedly mounted to the bottom surface; and a top surface that can be opened and closed to access the product tray contained within the packaging box.

3. The packaging box of claim 1, wherein the product tray includes a finger aperture adjacent to the support aperture to allow the product cup to be more easily removed from the support aperture.

4. The packaging box of claim 1, wherein the packaging box includes two product trays, and each product tray includes four to eight support apertures for supporting four to eight product cups.

5. The packaging box of claim 1, wherein the packaging box includes four product trays, and each product tray includes three to six support apertures for supporting three to six product cups.

* * * * *